US010400360B2

(12) United States Patent
Baier et al.

(10) Patent No.: US 10,400,360 B2
(45) Date of Patent: Sep. 3, 2019

(54) METHOD FOR PREPARING A YARN END FOR SPINNING-IN AT A ROTOR SPINNING DEVICE OF A ROTOR SPINNING MACHINE ALONG WITH A ROTOR SPINNING MACHINE

(71) Applicant: Rieter Ingolstadt GmbH, Ingolstadt (DE)

(72) Inventors: Frank Baier, Geisenfeld (DE); Jiri Sloupensky, Usti nad Orlici (CZ); Milos Ferkl, Usti nad Orlici (CZ); Jiri Kutlvasr, Chocen (CZ)

(73) Assignee: Reiter Ingolstadt GmbH, Ingolstadt (DE)

( * ) Notice: Subject to any disclaimer, the term of this patent is extended or adjusted under 35 U.S.C. 154(b) by 329 days.

(21) Appl. No.: 15/288,022

(22) Filed: Oct. 7, 2016

(65) Prior Publication Data

US 2017/0101728 A1 Apr. 13, 2017

(30) Foreign Application Priority Data

Oct. 8, 2015 (DE) ..... 10 2015 117 204

(51) Int. Cl.
*D01H 4/50* (2006.01)

(52) U.S. Cl.
CPC ..... *D01H 4/50* (2013.01)

(58) Field of Classification Search
CPC ..... D01H 4/50
See application file for complete search history.

(56) References Cited

U.S. PATENT DOCUMENTS 3,425,205 A * 2/1969 Landwehrkamp ..... D01H 4/48 57/263
4,114,356 A * 9/1978 Eckhardt ..... D01H 4/50 57/263

(Continued)

FOREIGN PATENT DOCUMENTS

DE 1 560 306 5/1972
DE 32 47 288 A1 6/1983

(Continued)

OTHER PUBLICATIONS

Machine Translation DE 102012110926 A1, May 2013.*
EP Search Report, dated Feb. 6, 2017.
German Search Report, dated Jun. 16, 2016.

*Primary Examiner* — Shaun R Hurley
(74) *Attorney, Agent, or Firm* — Dority & Manning, P.A.

(57) ABSTRACT

A rotor spinning machine and associated method are provided for preparing a yarn end for spinning-in at a rotor spinning device, wherein the rotor spinning machine has a rotor housing that is closable with a cover and subjected to negative pressure through a negative pressure channel. A spinning rotor is rotatably mounted in the rotor housing and rotates with an operating rotational speed during a spinning operation. With the method, the yarn end is introduced into the negative pressure channel. The yarn end is then interrupted with a severing structure defined on an open edge of the rotating spinning rotor. During the interruption of the yarn end, the spinning rotor is driven with a defined rotational speed for the preparation of the yarn end that is equal to or less than an operating rotational speed of the spinning rotor.

20 Claims, 4 Drawing Sheets

(56) References Cited

U.S. PATENT DOCUMENTS

| | | | | | |
|---|---|---|---|---|---|
| 4,166,356 | A * | 9/1979 | Chrtek | D01H 4/24 | 57/302 |
| 4,246,749 | A * | 1/1981 | Mikulecky | D01H 4/50 | 57/263 |
| 5,152,132 | A | 10/1992 | Strobel et al. | | |
| 5,694,756 | A * | 12/1997 | Lindner | D01H 4/44 | 57/263 |
| 2003/0010011 | A1* | 1/2003 | Meyer | D01H 4/24 | 57/417 |
| 2014/0366503 | A1* | 12/2014 | Griesshammer | D01H 4/02 | 57/350 |

FOREIGN PATENT DOCUMENTS

| | | | |
|---|---|---|---|
| DE | 39 36 748 | A1 | 11/1990 |
| DE | 41 31 684 | A1 | 3/1993 |
| DE | 195 53 389 | A1 | 6/1998 |
| DE | 101 50 565 | A1 | 4/2003 |
| DE | 10 2004 029 048 | A1 | 12/2005 |
| DE | 10 2006 036 713 | A1 | 2/2008 |
| DE | 10 2012 110 926 | A1 | 5/2013 |

* cited by examiner

METHOD FOR PREPARING A YARN END FOR SPINNING-IN AT A ROTOR SPINNING DEVICE OF A ROTOR SPINNING MACHINE ALONG WITH A ROTOR SPINNING MACHINE

FIELD OF THE INVENTION

The present invention relates to a method for preparing a yarn end for spinning-in at a rotor spinning device of a rotor spinning machine, whereas the rotor spinning machine features a rotor housing that can be closed with a cover and can be subjected to negative pressure through a negative pressure channel. A spinning rotor that is rotatably mounted in the rotor housing rotates with an operating rotational speed during the spinning operation along with a draw-off nozzle. With the method, the yarn end to be prepared is introduced into the negative pressure channel of the rotor spinning device, and is interrupted by a severing structure of the open edge of the rotating spinning rotor, and is thereby prepared for spinning-in. The invention further relates to a corresponding rotor spinning machine with at least one such rotor spinning device.

BACKGROUND

In order to, upon spinning at the rotor spinning machine, start the spinning process or, after the interruption of the spinning process, for example, based on a thread breakage or a quality cut or after the shutting down of the rotor spinning machine, resume the spinning process, a yarn end must always be prepared for the spinning-in process. For this purpose, it is necessary to fray the yarn end, in order to align the individual fibers of the yarn end for the spinning-in process and to free it of short fibers. The yarn end prepared for spinning-in must then be returned to the spinning rotor with a length that is measured as precisely as possible, in order to reconnect with the fiber material that is stored there.

For preparing yarn ends for spinning, preparing the yarn end pneumatically (for example) is known in the state of the art. Thereby, the yarn end is suspended on an air flow, which acts in the tangential, axial and or radial direction of the yarn end.

From DE 196 53 389 A1, preparing the yarn end by means of a rotating roller occupied with needles or saw teeth is further known. By means of such roller, it is possible to open wrap fibers typically present in rotor yarn, which can hamper the pneumatic preparation of the yarn end. Following the opening of the wrap fibers, a pneumatic preparation of the yarn end is carried out in turn.

From DE 10 2012 110 926 A1, preparing the yarn end by means of the edge area of the rotating spinning rotor is further known. For this purpose, with an at least partially opened rotor housing, the yarn is brought into the vicinity of the open edge of the spinning rotor. The spinning rotor is set in rotation and the cover of the rotor housing is closed, such that the yarn end is then pressed against the open edge of the rotor and severed. For this purpose, the edge of the spinning rotor is provided with a roughening or an abrasive. According to an additional embodiment, the yarn is introduced into the closed rotor housing, whereas a single driven rotor is displaced in its axial direction. After the introduction of the yarn end, the rotor is once again moved into its operating position and is set in rotation, such that, through the ramp-up of the rotor, an interruption of the yarn end arises. By means of this type of preparation of the yarn end, disrupting wrap fibers are opened and the preparation of the yarn end can be performed directly at the spinning station. However, this can lead to differences in the quality of the preparation of the yarn end with regard to the length and fraying of the yarn end.

SUMMARY OF THE INVENTION

Therefore, a task of the present invention is to propose a process for the preparation of the yarn end along with a corresponding rotor spinning machine, by means of which a favorable and uniform preparation of the yarn end can also be achieved in various applications. Additional objects and advantages of the invention will be set forth in part in the following description, or may be obvious from the description, or may be learned through practice of the invention.

In a method for preparing a yarn end for spinning-in at a rotor spinning device, whereas the rotor spinning device features a rotor housing that can be closed with a cover and can be subjected to negative pressure through a negative pressure channel, a spinning rotor that is rotatably mounted in the rotor housing and rotates with an operating rotational speed during the spinning operation along with a draw-off nozzle, the yarn end to be prepared is introduced into the negative pressure channel of the rotor spinning device, and is interrupted by a severing structure of the open edge of the rotating spinning rotor, and is thereby prepared for spinning in. During the interruption of the yarn end, the spinning rotor is driven with a defined rotational speed for the preparation of the yarn end. The rotational speed for the preparation of the yarn end is either equal to the operating rotational speed of the spinning rotor or less than the operating rotational speed of the spinning rotor.

By driving of the spinning rotor during the interruption of the yarn end with a defined rotational speed, the result is that the yarn ends are interrupted always under the same conditions with a defined severing speed, such that, with various applications, yarn ends with a substantially constant yarn end length are prepared and frayed. By driving the spinning rotor with a rotational speed for the preparation of the yarn end that is reduced compared to the operating rotational speed, a highly gentle severing of the yarn end also arises, which is thereby frayed with a high degree of uniformity. Due to the uniform, reproducible and favorable splitting up of the yarn ends, the success rate of the spinning-in process can be increased, such that machine efficiency is also increased overall. At the same time, through the yarn end that has been produced in an optimal manner, a favorable and reproducible quality of piecings is achieved, such that the quality of the yarn can be improved.

A rotor spinning machine is provided with at least one rotor spinning device with a rotor housing that can be closed with a cover and can be subjected to negative pressure through a negative pressure channel, with a spinning rotor rotatably mounted in the rotor housing and with a draw-off nozzle. An edge of the spinning rotor features a severing structure for interrupting and preparing a yarn end introduced in the negative pressure channel for spinning-in. A corresponding control unit for carrying out the method for preparing a yarn end is also provided. By means of the control unit, it is possible to, during the interruption of the yarn end, drive the spinning rotor with a defined rotational speed for the preparation of the yarn end, which is less than the operating rotational speed of the spinning rotor.

At this it is advantageous if the rotational speed for the preparation of the yarn end amounts to less than 80%, preferably less than 65%, and particularly preferably less than 55%, of the operating rotational speed, and preferably less than a spinning-in rotational speed of the spinning rotor. A severing of the yarn end that is too rapid, for which sufficient fraying cannot be achieved, is thereby avoided. In addition, in particular with a rotational speed for the preparation of the yarn end of less than 55% of the operating rotational speed, safety aspects can also be taken into account, if the preparation of the yarn end is carried out with a partially open rotor housing.

According to an additional form of the invention, it is advantageous if, prior to introducing the yarn end into the negative pressure channel, the cover of the rotor housing is transferred into an intermediate position, in particular a half-open position, and, with a stationary spinning rotor and a half-open rotor housing, the yarn end to be prepared is introduced into the negative pressure channel. Subsequently, the spinning rotor is set into rotation and driven with the rotational speed for the preparation of the yarn end for the predetermined time period, whereby the yarn is interrupted. Only after the interruption of the yarn end is the cover finally transferred into a closed position. For this purpose, the cover of the rotor housing can be brought at least into a closed position, an open position or an intermediate position, in particular a half-open position, or transferred back and forth between such positions.

According to an advantageous additional form of the method, the yarn end prepared for spinning-in is led back from the intermediate position into the closed position in the fiber-collecting groove of the spinning rotor already through the closing of the cover or the moving of the cover. However, it is also possible to make available the yarn length to be delivered back to the spinning rotor, in the conventional manner, through a temporary drive of the draw-off direction of the rotor spinning device counter to the regular draw-off direction.

For a favorable and reproducible preparation of the yarn end, it is also advantageous if, for the preparation of the yarn end, the spinning rotor is driven with the defined rotational speed for the preparation of the yarn end for a predetermined time period. The predetermined time period is herein specified in such a manner that, on the one hand, a reliable severing of the thread end during this time period can be assumed and, on the other hand, the spinning-in process can be rapidly resumed, in order to not adversely affect machine efficiency. In order to achieve an optimum preparation of the yarn end for all applications on the rotor spinning machine, it is further advantageous if the predetermined time period is adjusted depending on the type of the produced yarn and/or the type of the spinning rotor.

According to an advantageous additional form of the method, in the case of a predictable interruption of the spinning operation, the devices participating in yarn production, at least one feed device and one winding device are slowed down to a standstill in a controlled manner such that, after the controlled slowing down, the yarn end is located within the rotor spinning device, in particular within the draw-off nozzle. Thus, in the case of a predictable interruption of the spinning operation, the accumulation of the yarn end on the coil, with the subsequent elaborate thread search, can be avoided. The controlled shutting down of the rotor spinning device is advantageous in particular in connection with the preparation of the yarn end through the open edge of the spinning rotor, since the yarn remains completely in its regular thread run, and can be sucked directly into the negative pressure channel from its end position within the rotor spinning device or within the draw-off nozzle, which further contributes to an increase in machine efficiency.

At this, an advantageous additional form of the method provides that, after the controlled slowing down, the yarn end is unwound from a coil counter to its regular draw-off direction, introduced into the negative pressure channel of the rotor spinning device and is rewound, until a defective yarn piece is completely sucked into the negative pressure channel, and the yarn end is subsequently prepared for spinning in. In the case of a quality cut, the defective yarn piece can be directly sucked in through the negative pressure channel, severed and discarded. At this the preparation of the yarn end for spinning back in can take place at the same time as the severing of the defective yarn piece.

For rewinding the yarn end, the winding device and the draw-off device are advantageously driven counter to their regular direction of rotation, whereas the draw-off device is driven at a higher speed than the winding device. At this, the level of the speed refers to the peripheral speed of the draw-off device or the winding device, as the case may be, and thus to the speed at which the yarn is conveyed. Due to the more rapid drive of the draw-off device, the yarn to be wound is subjected to a tension draft, by which the adherence of the yarn on the coil, and any back-loops that may be caused by this, can be avoided. With a rotor spinning machine, it is herein advantageous if the winding device is provided for rewinding with a soft-start control.

For the controlled slowing down of the devices participating in the production of yarn, it is further advantageous if the spinning rotor is initially brought from its operating rotational speed to a rotational speed for slowing down, which is less than the operating rotational speed, and is driven with the rotational speed for slowing down for a predetermined time period. Only then is the spinning rotor slowed down to a standstill. Thus, during the controlled slowing down, a regular yarn can be produced, or at least the length of a defective yarn piece produced during the controlled slowing down can be reduced. At this it is particularly advantageous if the rotational speed for slowing down is equal to or less than the spinning-in rotational speed of the spinning rotor, since, thereby, the same operating conditions as those during spinning in essentially prevail.

In addition, it is advantageous if, after the transfer of the cover into the intermediate position and prior to the introduction of the yarn end in the negative pressure channel, the spinning rotor is subjected to a cleaning, in particular a pneumatic cleaning. It is herein advantageous that the cleaning of the spinning rotor can also take place in the intermediate position, and thus time can be saved, which in turn benefits machine efficiency. Of course, in addition to a pneumatic cleaning, a mechanical cleaning by means of a brush or a scraper is possible.

According to a particularly advantageous additional form of the rotor spinning machine, the negative pressure level in the negative pressure channel is adjustable. Thus, with the method of preparing a yarn end, an adjustment of the negative pressure level to the type of the produced yarn may be undertaken. For example, for yarns that are more difficult to suck in, the negative pressure level can be increased.

It is also advantageous if the negative pressure level in the negative pressure channel is increased, at least temporarily, prior to the introduction of the yarn end into the negative pressure channel. Thereby, the introduction of the yarn end into the negative pressure channel can be facilitated.

In order to reliably perform the interruption of the yarn end, it is also advantageous if, during its interruption, the yarn end is moved in its longitudinal direction by means of a draw-off device of the rotor spinning device, preferably in an oscillating manner. In addition to supporting the severing process, the length of the prepared yarn end can also be adjusted by the movement of the yarn end.

If, for a predictable interruption of the spinning operation, the rotor spinning device or the devices participating in the production of yarn are slowed down in a controlled manner, it is advantageous if, during a standstill of the rotor spinning device, the yarn end is fixed by means of a draw-off tube or a clamping device in the spinning device, in particular in the draw-off nozzle. For this purpose, the rotor spinning device features, preferably with reference to the regular draw-off direction of the yarn, a draw-off tube downstream of the draw-off nozzle and/or a clamping device downstream of the draw-off nozzle. Thus, the slipping out of the yarn end from the rotor spinning device can be avoided, even with a switched-off spinning device and non-effective negative pressure.

According to an additional form of the rotor spinning machine, it is advantageous if a cover element is arranged on the rotor housing, which cover element at least partially covers, in the intermediate position of the cover, a gap between the rotor housing and the cover. It is thereby possible to maintain a negative pressure level, even with a partially open cover in the rotor housing.

For a reliable interruption of the yarn end and preparation of the yarn for spinning in, it is also advantageous if the spinning rotor of the rotor spinning device is provided with a toothing or a knurling in at least one partial area of its edge, preferably in two opposite partial areas of its edge. Given that only small partial areas of the edge are provided with the severing structure, any potential adverse effects of the severing structure on the spinning result and on the energy demand of the spinning rotor can be largely avoided.

According to an additional advantageous embodiment of the rotor spinning machine, the entrance area of the negative pressure channel is provided with at least one wear protection device, in particular a wear protection ring. Thereby, signs of wear through the action of the yarn end that is sucked in can be avoided.

BRIEF DESCRIPTION OF THE DRAWINGS

Additional advantages of the invention are described on the basis of the following presented embodiments. The following is shown.

DETAILED DESCRIPTION

Figure 1:
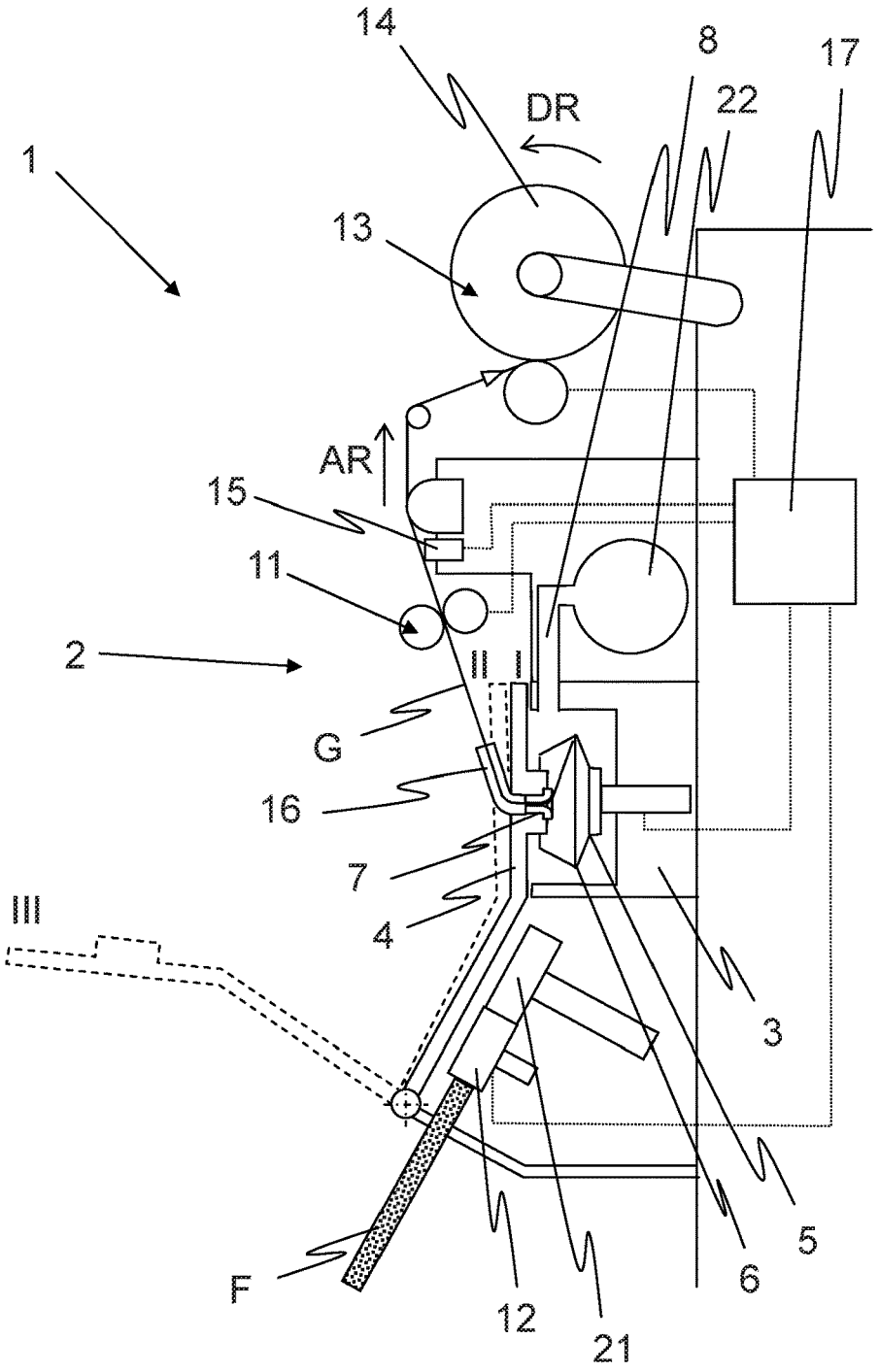
FIG. 1 shows a rotor spinning device of a rotor spinning machine in a schematic, cut-away overview.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a rotor spinning device 2 of a rotor spinning machine 1 in a schematic sectional view. In a conventional manner, the rotor spinning device 2 features a rotor housing 3, in which a spinning rotor 5 is rotatably mounted and rotates with an operating rotational speed during the operation of the rotor spinning device 2. A fiber material F to be spun is fed by a feed device 12 and a splitting device (e.g. opening device) 21 to the spinning rotor 5, where it is split into individual fibers, and is stored in a fiber-collecting groove 6 of the spinning rotor 5 in the form of a fiber ring. From there, it is integrated into the end of the yarn G produced in the rotor spinning device 2. In a manner that is likewise known, the yarn produced in the spinning rotor 5 is drawn off through a draw-off nozzle 7 by means of a draw-off device 11, which in the present case is formed by two draw-off rollers, and is wound on a coil 14 by means of a winding device 13. The rotor housing 3 is connected by means of a negative pressure channel 8 to a central negative pressure channel 22 of the rotor spinning machine 1 and is thereby subjected to a negative spinning pressure. During the spinning operation, the rotor housing 3 is closed by a cover 4.

The draw-off nozzle 7, and according to the present representation, a draw-off tube 16 as well, is arranged in the cover 4. However, the draw-off tube 16 is not absolutely necessary; likewise, instead of the draw-off tube 16, only one spin retaining element can also be provided, which may also be formed in one piece with the draw-off nozzle 7. However, the draw-off tube 16 is advantageous for, upon an interruption of the spinning operation, fixing the yarn G within the rotor spinning device 2, as will be explained below. According to the present view, the cover 4 of the rotor housing 3 is a component of a pivot housing, which also covers the splitting device 21 and, if applicable, additional devices of the rotor spinning device 2. However, as shown in FIGS. 2-5, it may also be provided with a separate cover 4 for the rotor housing 3.

In the present case, the cover 4 is shown in solid lines in a closed position I. From this position, the cover can be transferred into an intermediate position II (shown with a dashed line), in which both a cleaning of the spinning rotor 5 and the preparation of a yarn end, along with a rewinding of the defective yarn piece, can take place. Further, the cover 4 can be transferred into an open position III, in which it is possible to manually clean the spinning rotor 5 or remove it from the rotor spinning device 2.

The rotor spinning device 2 shown in the present case also has a yarn monitoring device 15, by means of which at least one parameter of the finished spun yarn G is monitored. If a yarn defect is detected by the yarn monitoring device 15, the spinning process is interrupted and the yarn G that is already produced is rewound in one piece, in order to remove the defective yarn piece.

Furthermore, the rotor spinning device 2 or the rotor spinning machine 1 features a control unit 17, by means of which the various devices of the rotor spinning device 2 can be controlled both during normal operation and during spinning in. In the present case, the winding device 13, the yarn monitoring device 15, the draw-off device 11, the spinning rotor 5 and the feed device 12 are connected to the control unit 17 in a signal-transferring manner, as shown by the dotted lines.

The preparation of a yarn end 9 for spinning-in is now shown with reference to FIGS. 2-5. The method for preparing a yarn end 9 is initially described for a spinning-in after a planned interruption of the spinning operation with a controlled shutting down of the rotor spinning device 2. Such planned interruptions occur, for example, for maintenance purposes, for changing the coil, prior to shutting down the rotor spinning machine 1, or in the case of detecting a yarn defect. At this, the devices of the rotor spinning device 2 involved in the yarn production, which in the present case comprise the feed device 12, the draw-off device 11 along with the winding device 13, are slowed down to a standstill in a controlled manner in such a manner that the yarn G does not tear and accumulate on the coil 14, but is further produced until the interruption of the spinning process. Thus, after the interruption of the spinning process, the yarn end 9 is located in a defined position. In order to facilitate the preparation of the yarn end 9 for spinning-in, in the present case, the devices 11, 12, 13 are slowed down in such a manner that the yarn end 9 is located within the draw-off nozzle 7.

Figure 2:
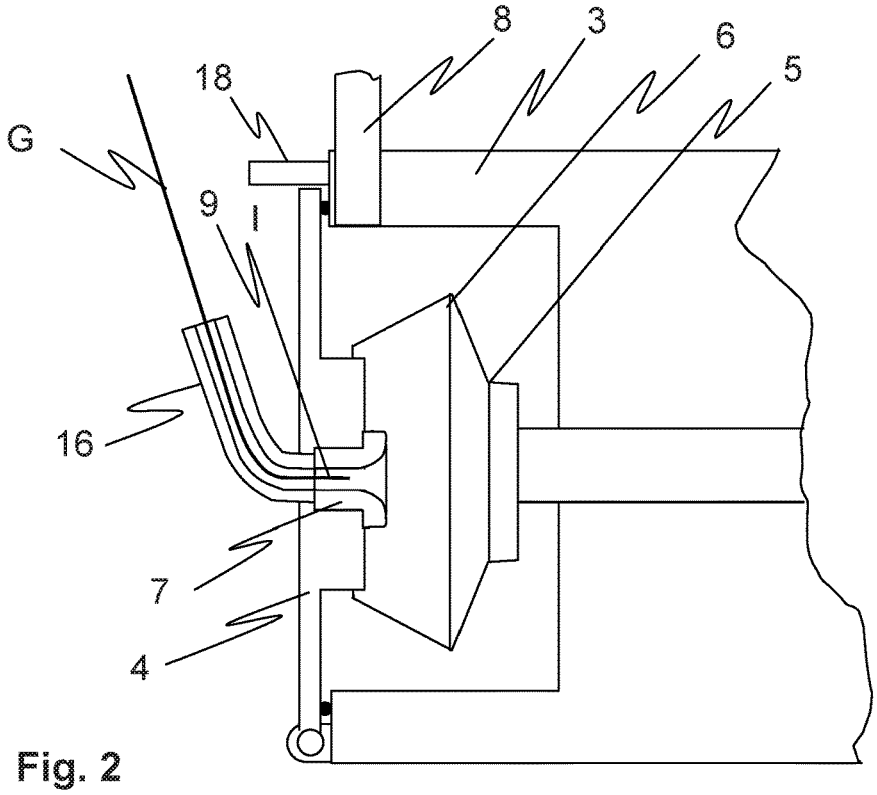
FIG. 2 is a detailed view of the rotor housing of the rotor spinning device in a schematic, cut-away view after an interruption of the spinning process.
Figure 7:
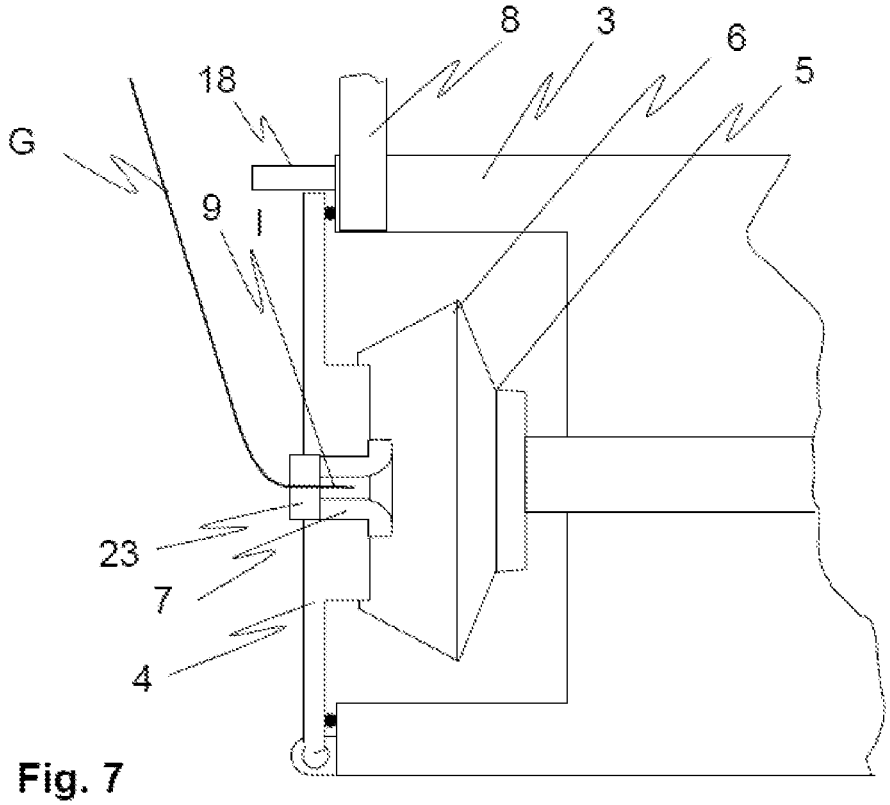
FIG. 7 is a view of the rotor housing; and particularly depicts a clamping device.

FIG. 2 shows the rotor spinning device 2 and the rotor housing 3 in a position in which the spinning process was just interrupted, and the yarn end 9 is located within the draw-off nozzle 7. At this point in time, the cover 4 of the rotor housing 3 is still closed. However, the method for preparing a yarn end 9 for spinning-in is also applicable in the case of an unplanned interruption in the spinning operation, for example because of a thread breakage. In this case, the yarn end 9 accumulates on the coil 14, and from there must be sought out either by an operator or by an automatic maintenance device, which can be arranged in a movable or stationary manner on the rotor spinning machine 1, and led back into the rotor spinning device 2, in this case through the draw-off tube 16. After the yarn end 9 has been sucked into the rotor spinning device 2, it is likewise found approximately in the shown position. Both after a planned and after an unplanned interruption in the spinning operation, it is, of course, also possible that the yarn end 9 is found at a different location within the rotor spinning device 2, for example, within the draw-off tube 16, or fixed by a clamping device 23 (FIG. 7). However, the position within the draw-off nozzle 7 is particularly advantageous for the subsequent sucking in of the yarn end 9.

Figure 3:
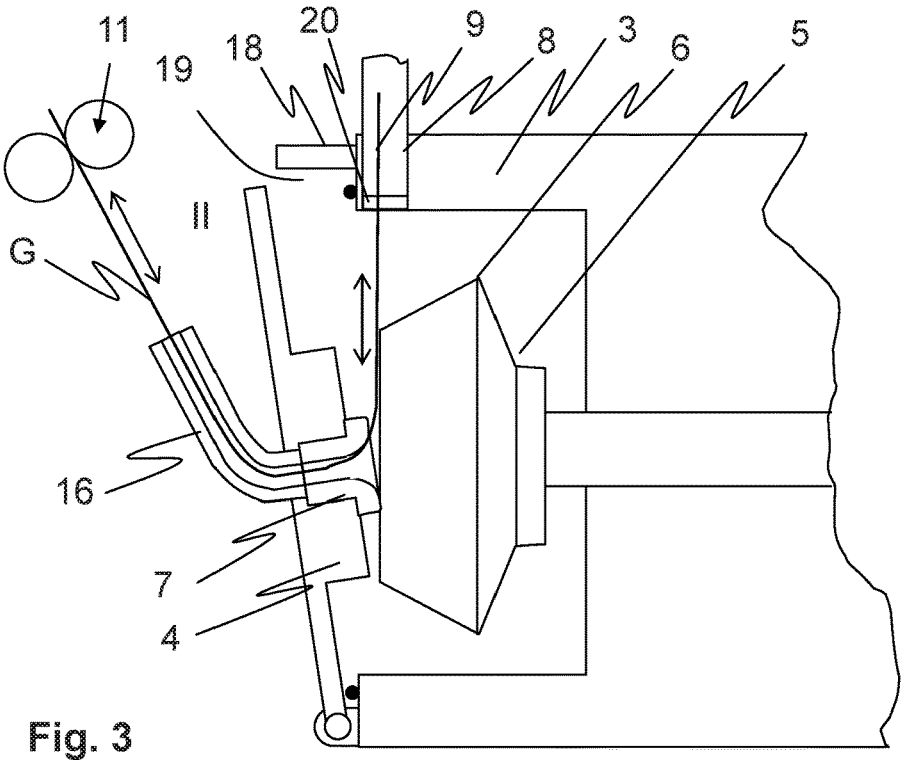
FIG. 3 shows the rotor housing of FIG. 2 after the sucking in of a yarn end.

Now that the yarn end 9 is located in the defined position within the draw-off nozzle 7, it can be introduced into the negative pressure channel 8, which is shown in FIG. 3. For this purpose, the cover 4 is moved from its closed position I into its intermediate position II, such that, through the action of the negative pressure in the negative pressure channel 8, the yarn end 9 can be sucked into it. In order to, in the intermediate position II as well, keep available sufficient negative pressure in the rotor housing 3, in the present case, a cover element 18 is arranged at the rotor housing 3, which at least partially covers the gap 19 between the rotor housing 3 and the cover 4 found in the intermediate position II. Furthermore, a wear protection device 20 can be provided in the negative pressure channel 8 shown in FIG. 3. In this case, this is formed as a wear ring made of a metal, which is used in the entrance area of the negative pressure channel 8 at the transition to the rotor housing 3, in order to protect it from cuts by the yarn G upon sucking in.

In order to make available the additional yarn length necessary for sucking in, the yarn G in the meantime is delivered back from the coil 14, in the present case by means of the draw-off device 11, counter to the regular draw-off direction AR (see FIG. 1). The yarn end 9 now takes on the course shown in FIG. 3, in which, based on the negative pressure in the negative pressure channel 8, it is securely held. At this, the yarn end 9 lies immediately adjacent to the open edge of the spinning rotor 5 or directly contacts it, such that the preparation of the yarn end can now be undertaken.

Optionally, a rotor cleaning can be carried out prior to the sucking in of the yarn end 9. For this purpose, for example, through the open gap 19 between the cover 4 and the rotor housing 3, a blowing nozzle (not shown) can be incorporated in the rotor housing 3, in order to blow out the fiber-collecting groove 6 of the spinning rotor 5. Particularly in the case of a controlled interruption of the spinning process, this is not absolutely necessary, since, based on the gradual reduction of the feed, hardly any fibers are able to be deposited in the fiber-collecting groove 6.

In order to interrupt the yarn end 9 and prepare it for spinning in, the spinning rotor 5 is now set in rotation and driven with a defined rotational speed for the preparation of the yarn end for a certain time period. While the spinning rotor 5 is operated with an operating rotational speed of between approximately 80,000 1/min and 170,000 1/min, it is advantageous for the preparation of the yarn end to provide a substantially lower rotational speed for the preparation of the yarn end of between 20,000 to 50,000 1/min per minute. Thereby, on the one hand, a safe interruption of the yarn end 9 and, on the other hand, a sufficient fraying and orientation of the fibers, are ensured. In contrast, with a rotational speed for the preparation of the yarn end that is too rapid, a severing of the yarn end 9 that is too rapid and thus an insufficient preparation of the yarn end may arise. Preferably, the time period during which the spinning rotor 5 is driven for the preparation of the yarn end may be preset depending on the type of fiber material used F and the type of yarn produced G. Typically, the time period for the successful preparation of the yarn end 9 is approximately 5 seconds; however, for yarns G that are more difficult to sever, such as coarse yarns, the time period may amount to more than 5 seconds.

According to the example shown herein, it is also provided to move the yarn end 9, at least temporarily during the preparation of the yarn end, back and forth in its longitudinal direction by means of the draw-off device 11, in order to, on the one hand, assist in the interruption of the yarn end 9 and, on the other hand, ensure a sufficient length of the prepared yarn end 9. For this purpose, the draw-off device 11 is driven in an oscillating manner, whereas, depending on the type of the yarn G and the desired length of the prepared yarn end 9, a movement of between 2 mm and 10 mm can be carried out.

Figure 4:
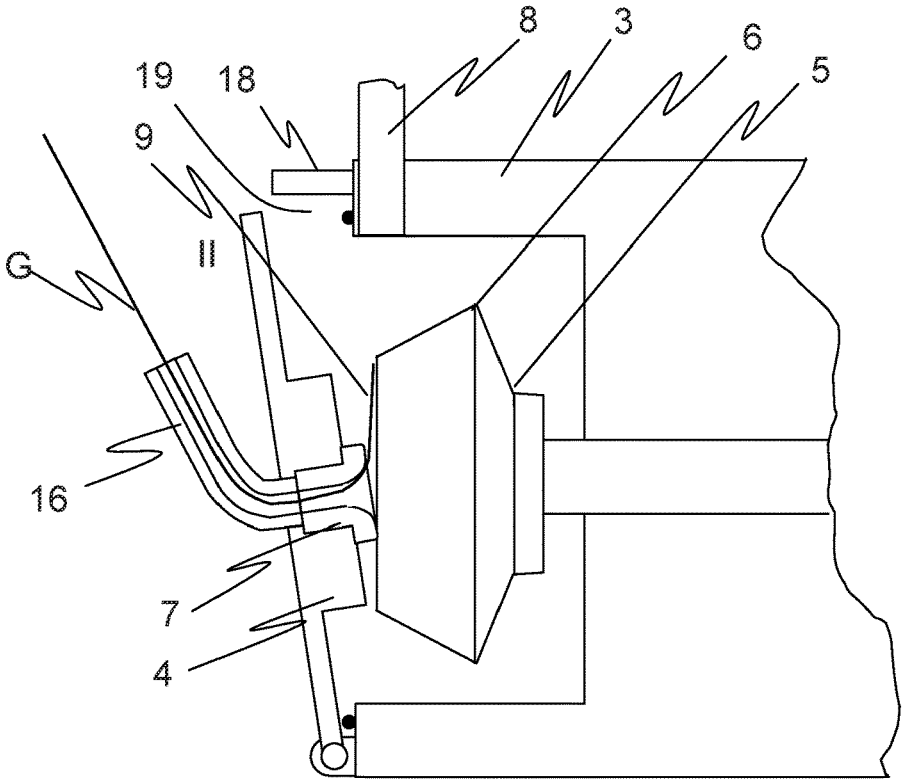
FIG. 4 is a detailed view of the rotor housing after the preparation of the yarn end.
Figure 5:
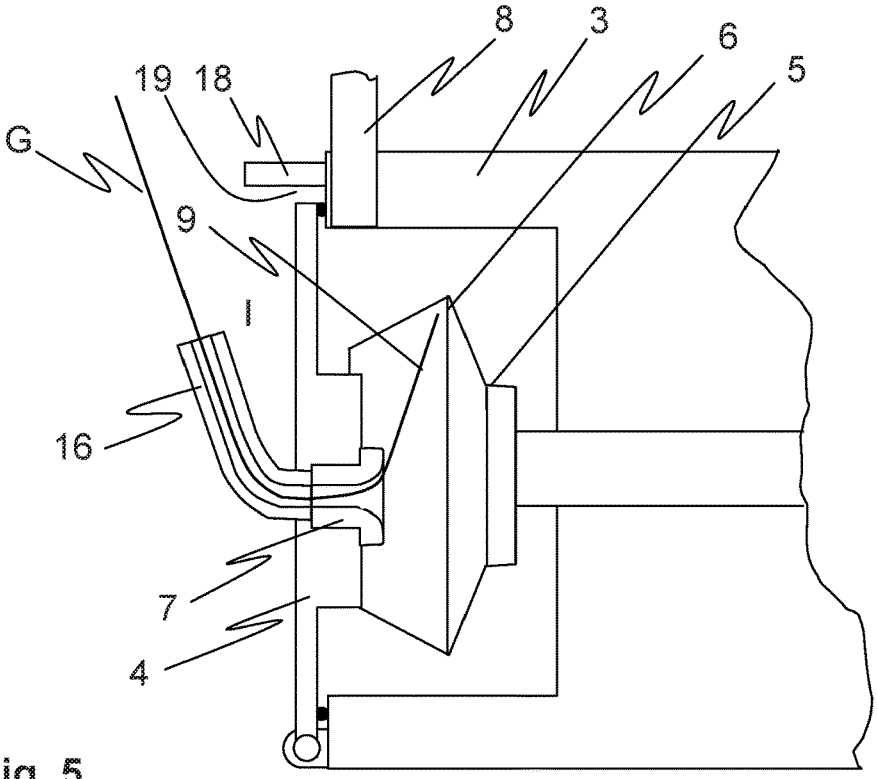
FIG. 5 is a detailed view of the rotor housing after the return delivery of the yarn end into the fiber-collecting groove.

Now that the yarn end 9 has been successfully interrupted by the open edge of the spinning rotor 5 and is prepared for spinning-in, it takes the position shown in FIG. 4. At this, through the negative pressure channel 8 and the central negative pressure channel 22 of the rotor spinning machine 1, the severed yarn end 9 has been sucked away and discarded, while the newly created yarn end 9 is now ready for spinning-in, which will be described below with reference to FIG. 5.

In a similar manner, the preparation of the yarn end takes place after the detection of a yarn defect by a yarn-monitoring device. At this, as described above with reference to FIG. 2, the rotor spinning device 2 is stopped in a controlled manner, such that the yarn end 9 is located in the position shown in FIG. 2. As also previously described, with the return delivery of the yarn G, the yarn end 9 is sucked into the negative pressure channel 8 and is located in the position shown in FIG. 3. In order to now sever the defective yarn piece from the yarn G, the yarn G is further unwound from the coil 14 counter to the regular draw-off direction AR (see FIG. 1) and is continuously sucked into the negative pressure channel 8, until the defective yarn piece is fully sucked into the negative pressure channel 8. At this, the secure sucking in of the complete defective yarn piece can be ensured, for example, by the number of revolutions of the draw-off rollers of the draw-off device 11.

At this, for rewinding the defective yarn piece, the draw-off device 11 is preferably driven, with reference to the circumferential speed or the transport speed of the yarn G, somewhat more rapidly than the winding device 13, such that the yarn G is held under tension, and so-called "back-loops," the rearward winding of the yarn G upon rewinding, can be avoided. In order to support the secure sucking in of the yarn end 9 in the negative pressure channel 8, the winding device 13 is preferably provided with a soft-start control, such that the coil 14, and thus the yarn G, is accelerated gradually and not with jerks. Therefore, it is also advantageous if the speed of the yarn G is adjustable during rewinding G. Thereby, yarns G, which, due to their structure or their diameter, are difficult to introduce into the negative pressure channel 8, are rewound at a slower speed. Therefore, it may also be sensible that the negative pressure level in the negative pressure channel 8 can be adjusted. It is thereby possible to, for example, temporarily increase the negative pressure level for sucking in the yard ends 9, both for the preparation of the yarn end and for rewinding for the elimination of a yarn defect, or to adjust it to the type of yarn G. For example, for yarns that are relatively difficult to sever, the negative pressure level can be increased in order to keep such yarns taut and to facilitate the interruption by means of the open edge of the spinning rotor.

Now that the incorrect yarn piece is fully sucked into the negative pressure channel 8, the draw-off device 11 and the winding device 13 are stopped, and the spinning rotor 5 are in turn driven with the rotational speed for the preparation of the yarn end, in order to prepare the yarn end 9. The yarn end 9 now once again takes on the course shown in FIG. 4.

In order to now once again spin in the yarn end 9, according to a particularly advantageous embodiment, it is only necessary to transfer the cover 4 from the intermediate position II back into the closed position I. The yarn end 9 is thereby discharged into the fiber-collecting groove 6 of the spinning rotor 5, and can be connected to the fibers that are present there based on the feeding that has already been resumed. At this, the possibly required additional length of the yarn end 9 can be made available by the change to the position of the yarn end 9 when closing the cover 4. However, it is also possible to make available a required, additional yarn length through a temporary drive of the draw-off device 11 counter to the regular draw-off direction AR.

For spinning-in, in a conventional manner, the spinning rotor 5 is operated with a spinning-in rotational speed that is reduced compared to the regular operating rotational speed, which may be, for example, approximately 60% to 80% of the operating rotational speed. Thereby, during the ramp-up of the drives, the feeding in of the fibers, the yarn formation, and the yarn draw-off can be better coordinated with each other. After successfully spinning-in, the regular spinning process may finally be started, whereas the spinning rotor 5 is accelerated to its regular operating rotational speed.

Figure 6:
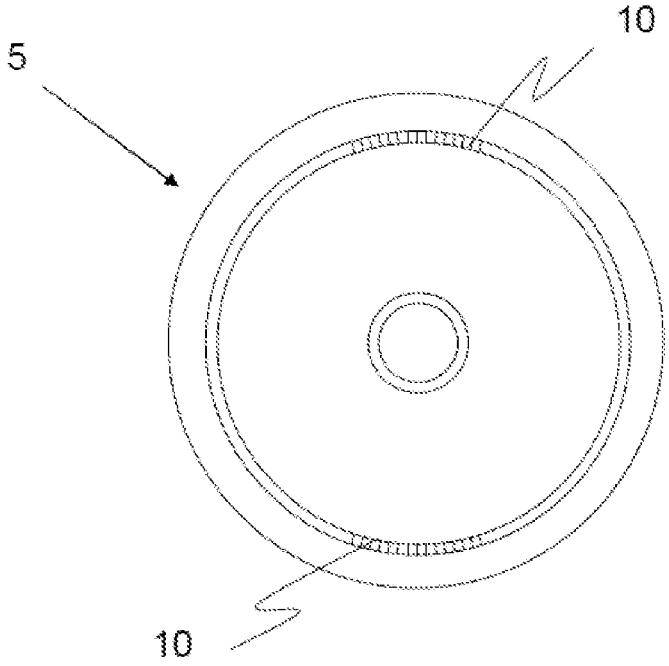
FIG. 6 is a top view of the open edge of a spinning rotor with a severing structure.

Finally, FIG. 6 shows a top view of the open edge of a spinning rotor 5, which is equipped with severing structures 10 for interrupting and preparing a yarn end 9 for spinning in. In the present case, the edge of the spinning rotor 5 features two partial areas arranged opposite to each other, which are provided with a severing structure 10. At this, the severing structure 10 is formed by a knurling with several adjacent notches. However, other embodiments of the severing structure 10 are also possible.

By means of the described method, it is possible to reproducibly achieve a very favorable preparation of the yarn end, also in various applications and various types of rotors. In particular, the length of the prepared yarn 9 is subjected to fluctuations that are only very slight. In addition, through the severing structure 10, in particular in conjunction with the movement of the yarn end 9 in its longitudinal direction, a very uniform splitting up of the yarn end and the alignment of the fibers can be achieved, such that piecings of high quality can be produced. It is particularly advantageous that all of the described events of rotor cleaning and the suction of the yarn end 9 can be performed up to the rewinding of a defective yarn piece in the intermediate position II of the cover 4, by which considerable time savings can be achieved.

Modifications and variations can be made to the embodiments illustrated or described herein without departing from the scope and spirit of the invention as set forth in the appended claims.

LIST OF REFERENCE SIGNS

1 Rotor spinning machine
2 Rotor spinning device
3 Rotor housing
4 Cover
5 Spinning rotor
6 Fiber-collecting groove of the spinning rotor
7 Draw-off nozzle
8 Negative pressure channel
9 Yarn end
10 Severing structure
11 Draw-off device
12 Feed device
13 Winding device
14 Coil
15 Yarn-monitoring device
16 Draw-off tube
17 Control unit
18 Cover element
19 Gap
20 Wear protection device
21 Splitting device
22 Central negative pressure channel
I Closed position
II Half-open position
III Open position
AR Draw-off device
DR Regular direction of rotation
F Fiber material
G Yarn

The invention claimed is:

1. A method for preparing a yarn end for spinning-in at a rotor spinning device of a rotor spinning machine, the rotor spinning machine having a rotor housing that is closable with a cover and subjected to negative pressure through a negative pressure channel, a spinning rotor rotatably mounted in the rotor housing and that rotates with an operating rotational speed during a spinning operation, and a draw-off nozzle, the method comprising:

introducing the yarn end into the negative pressure channel;

interrupting the yarn end with a severing structure defined on an open edge of the rotating spinning rotor;

wherein for the interruption of the yarn end, the spinning rotor is brought to and held for a predetermined period of time at a predefined rotational speed for the preparation of the yarn end that is equal to or less than an operating rotational speed of the spinning rotor.

2. The method according to claim 1, wherein the predefined rotational speed for the preparation of the yarn end is less than 80% of a spinning-in rotational speed of the spinning rotor.

3. The method according to claim 1, wherein prior to introducing the yarn end into the negative pressure channel, the cover of the rotor housing is transferred into an intermediate position and the yarn end is introduced into the spinning rotor in a stationary state, wherein the spinning rotor is then set into rotation and is driven with the predefined rotational speed for the preparation of the yarn end for the predetermined time period and the yarn end is interrupted, and after the interruption of the yarn end, the cover is transferred into a closed position.

4. The method according to claim 3, wherein the predetermined time period during which the spinning rotor is driven with the predefined rotational speed for the preparation of the yarn end is adjusted depending on one or both of a type of the produced yarn or a type of the spinning rotor.

5. The method according to claim 1, wherein in the case of a predictable interruption of the spinning operation, a feed device and a winding device of the rotor spinning machine involved in yarn production are slowed to a standstill in a controlled manner such that the yarn end is subsequently located within the rotor spinning device.

6. The method according to claim 5, wherein after the controlled slowing down, the yarn end is unwound from a coil, introduced into the negative pressure channel of the rotor spinning device, and sucked into the negative pressure channel until a defective yarn piece is completely sucked into the negative pressure channel, wherein the yarn end is subsequently prepared for spinning-in.

7. The method according to claim 6, for unwinding the yarn end, the winding device and a draw-off device are driven counter to their operational direction of rotation, whereas the draw-off device is driven at a higher speed than the winding device.

8. The method according to claim 5, wherein for the controlled slowing down, the spinning rotor is initially brought from its operating rotational speed to a lesser rotational speed for slowing down, and is driven at the lesser rotational speed for slowing down for a predetermined time period, and then is slowed down to a standstill.

9. The method according to claim 8, wherein the lesser rotational speed for slowing down is equal to or less than a spinning-in rotational speed of the spinning rotor.

10. The method according to claim 3, wherein after the transfer of the cover into the intermediate position and prior to the introduction of the yarn end into the spinning rotor, the spinning rotor is subjected to a cleaning process.

11. The method according to claim 1, wherein a level of the negative pressure level in the negative pressure channel during the preparation of the yarn end is adjustable.

12. The method according to claim 1, wherein a level of the negative pressure level in the negative pressure channel is increased prior to the introduction of the yarn end into the negative pressure channel.

13. The method according to claim 5, wherein during the standstill of the rotor spinning device, the yarn end is fixed by means of a draw-off tube or a clamping device in the rotor spinning device.

14. A rotor spinning machine, comprising:

a rotor spinning device, the rotor spinning device further comprising a rotor housing closable with a cover, the rotor housing subjected to negative pressure through a negative pressure channel;

a spinning rotor rotatably mounted in the rotor housing along with a draw-off nozzle;

the spinning rotor further comprising an open edge provided with a severing structure disposed thereon; and a control unit in communication with the rotor spinning device to control the rotor spinning device to interrupt and prepare a yarn end introduced in the negative pressure channel for a subsequent spinning-in by:

introducing the yarn end into the negative pressure channel;

interrupting the yarn end with the severing structure defined on the open edge of the rotating spinning rotor; and wherein for the interruption of the yarn end, the spinning rotor is brought to and held for a predetermined period of time at a predefined rotational speed for the preparation of the yarn end that is equal to or less than an operating rotational speed of the spinning rotor.

15. The rotor spinning machine according to claim 14, wherein the cover is movable between a closed position, an intermediate position, and an open position.

16. The rotor spinning machine according to claim 15, further comprising a cover element arranged on the rotor housing to at least partially cover a gap between the rotor housing and the cover in the intermediate position of the cover.

17. The rotor spinning machine according to claim 14, wherein a negative pressure level in the negative pressure channel is adjustable.

18. The rotor spinning machine according to claim 14, further comprising a wear protection ring at an entrance area of the negative pressure channel.

19. The rotor spinning machine according to claim 14, wherein the severing structure comprises a toothing or a knurling defined on at least one partial area of the open edge of the spinning rotor.

20. The rotor spinning machine according to claim 14, wherein the rotor spinning device further comprises a draw-off tube downstream of the draw-off nozzle, and a clamping device downstream of the draw-off nozzle.

* * * * *